US009119437B2

(12) United States Patent
Weller et al.

(10) Patent No.: US 9,119,437 B2
(45) Date of Patent: Sep. 1, 2015

(54) RECONFIGURABLE SHOE

(76) Inventors: Axel Weller, Las Vegas, NV (US); Justin Siefert, Las Vegas, NV (US)

( * ) Notice: Subject to any disclaimer, the term of this patent is extended or adjusted under 35 U.S.C. 154(b) by 231 days.

(21) Appl. No.: 13/524,587

(22) Filed: Jun. 15, 2012

(65) Prior Publication Data

US 2013/0333246 A1 Dec. 19, 2013

(51) Int. Cl.

| | |
|---|---|
| ***A43B 21/36*** | (2006.01) |
| ***A43B 13/22*** | (2006.01) |
| ***A43B 13/00*** | (2006.01) |
| ***A43B 3/12*** | (2006.01) |
| ***A43B 3/26*** | (2006.01) |
| ***A43B 3/24*** | (2006.01) |
| ***A43B 13/14*** | (2006.01) |
| ***A43B 13/36*** | (2006.01) |
| ***A43B 21/42*** | (2006.01) |

(52) U.S. Cl.

CPC ..... *A43B 3/128* (2013.01); *A43B 3/244* (2013.01); *A43B 3/246* (2013.01); *A43B 3/26* (2013.01); *A43B 13/141* (2013.01); *A43B 13/36* (2013.01); *A43B 21/42* (2013.01)

(58) Field of Classification Search

CPC ..... A43B 21/433; A43B 3/24; A43B 3/26; A43B 21/46; A43B 21/48; A43B 21/42; A43B 3/248; A43B 5/0427; A43B 13/141; A43B 13/16; A43C 17/0086

USPC ..... 36/100, 103, 42, 81, 97, 25 R

See application file for complete search history.

(56) References Cited

U.S. PATENT DOCUMENTS

| | | | | | |
|---|---|---|---|---|---|
| 2,177,571 | A | * | 10/1939 | Kirke | 36/11.5 |
| 2,304,957 | A | * | 12/1942 | Roth | 36/33 |
| 2,517,472 | A | * | 8/1950 | Fathauer | 36/11.5 |
| 2,590,648 | A | * | 3/1952 | Pitz | 36/11.5 |
| 4,290,212 | A | | 9/1981 | Matsson | |
| 4,670,996 | A | | 6/1987 | Dill | |
| 4,839,972 | A | * | 6/1989 | Pack et al. | 36/117.2 |
| 4,962,760 | A | * | 10/1990 | Jones | 602/27 |
| 5,024,611 | A | * | 6/1991 | Eckerle et al. | 446/268 |

(Continued)

FOREIGN PATENT DOCUMENTS

| | | |
|---|---|---|
| JP | 05/168504 | 7/1993 |
| KR | 20/0396021 | 9/2005 |

OTHER PUBLICATIONS

International Search Report and Written Opinion, dated Sep. 16, 2013.

*Primary Examiner* — Jila M Mohandesi
*Assistant Examiner* — Katharine Gracz
(74) *Attorney, Agent, or Firm* — Greenberg Traurig, LLP

(57) ABSTRACT

A shoe having a hinge member incorporated between a footbed toe plate and footbed arch plate allowing the shoe to be configured as a flat or heeled shoe. The footbed toe plate and footbed arch plate are rotatably joined via one or more hinge pins inserted through interlaced teeth of each plate. A spring-biased hinge lock extending between the plates is controlled by a spring-biased pin having a notch for selectively receiving the hinge lock such that the hinge lock disengages the footbed arch plate allowing the footbed arch plate to rotate relative to the footbed toe plate. The heel block includes a spring-biased heel lock extending into a removable heel and is controlled by a spring-biased pin having a notch for selectively receiving the hinge lock such that the hinge lock disengages the heel allowing the heel to be removed from the heel block.

16 Claims, 19 Drawing Sheets

(56) References Cited

U.S. PATENT DOCUMENTS

| | | | | |
|---|---|---|---|---|
| 5,309,651 | A * | 5/1994 | Handel | 36/100 |
| 5,347,730 | A | 9/1994 | Colon | |
| 5,410,820 | A * | 5/1995 | Goodman | 36/25 R |
| 5,481,814 | A | 1/1996 | Spencer | |
| 5,572,806 | A * | 11/1996 | Osawa | 36/117.4 |
| 5,926,975 | A | 7/1999 | Goodman | |
| 7,168,184 | B2 | 1/2007 | Wallin et al. | |
| 7,578,077 | B2 * | 8/2009 | Marc | 36/103 |
| 7,877,902 | B2 | 2/2011 | Pieriboni | |
| 2002/0184792 | A1 * | 12/2002 | Sugawara | 36/28 |
| 2006/0075662 | A1 | 4/2006 | Schupbach | |
| 2008/0168683 | A1 | 7/2008 | Keating | |
| 2008/0184598 | A1 | 8/2008 | Handel | |
| 2010/0071233 | A1 | 3/2010 | Savill | |
| 2010/0139123 | A1 | 6/2010 | Alan | |
| 2010/0146817 | A1 | 6/2010 | Crispo | |
| 2011/0119954 | A1 * | 5/2011 | Ortiz | 36/42 |
| 2012/0137543 | A1 | 6/2012 | Kemp | |

* cited by examiner

RECONFIGURABLE SHOE

CROSS REFERENCE

This application is related to U.S. patent application Ser. No. 13/491,917 filed Jun. 8, 2012.

FIELD OF THE INVENTION

The embodiments of the present invention relate to a shoe having an adjustable footbed and interchangeable heels.

BACKGROUND

It is well-known that women have a natural affinity to shoes. Women tend to own numerous pairs of shoes of many different types for many different occasions. Given the price of shoes, it would be advantageous for women to own shoes capable of multiple configurations. Besides financial considerations, shoes capable of multiple configurations require less storage space and provide versatility.

Thus, the embodiments of the present invention are directed to a reconfigurable shoe incorporating means to adjust a footbed and interchange heels thereof.

SUMMARY

In one embodiment of the present invention, a hinge member incorporated between a footbed toe plate and footbed arch plate permits a shoe to be modified from a flat to a heeled shoe while a heel mechanism allows different heels to be interchanged with the shoe.

In one embodiment, the hinge member comprises the footbed toe plate and footbed arch plate rotatably joined via one or more hinge pins inserted through interlaced teeth of each plate. A spring-biased hinge lock extending between the two plate sections is controlled by a spring-biased in positioned with the notch selectively receiving the hinge lock such that the hinge lock disengages said footbed arch plate allowing said footbed arch plate to rotate relative to said footbed toe plate.

In one embodiment of the present invention, a heel interchanging mechanism comprises a spring-biased heel lock extending between a heel block an heel is controlled by a spring-biased notched pin positioned with the notch selectively receiving the hinge lock such that the hinge lock disengages said heel allowing said heel to be freely removed from said heel block.

Other variations, embodiments and features of the present invention will become evident from the following detailed description, drawings and claims.

BRIEF DESCRIPTION OF THE DRAWINGS

FIGS. 1*f* and 1*g* illustrate perspective views of alternative spring-biased pins for use with the shoe hinge member according to the embodiments of the present invention;

DETAILED DESCRIPTION

Figure 1:
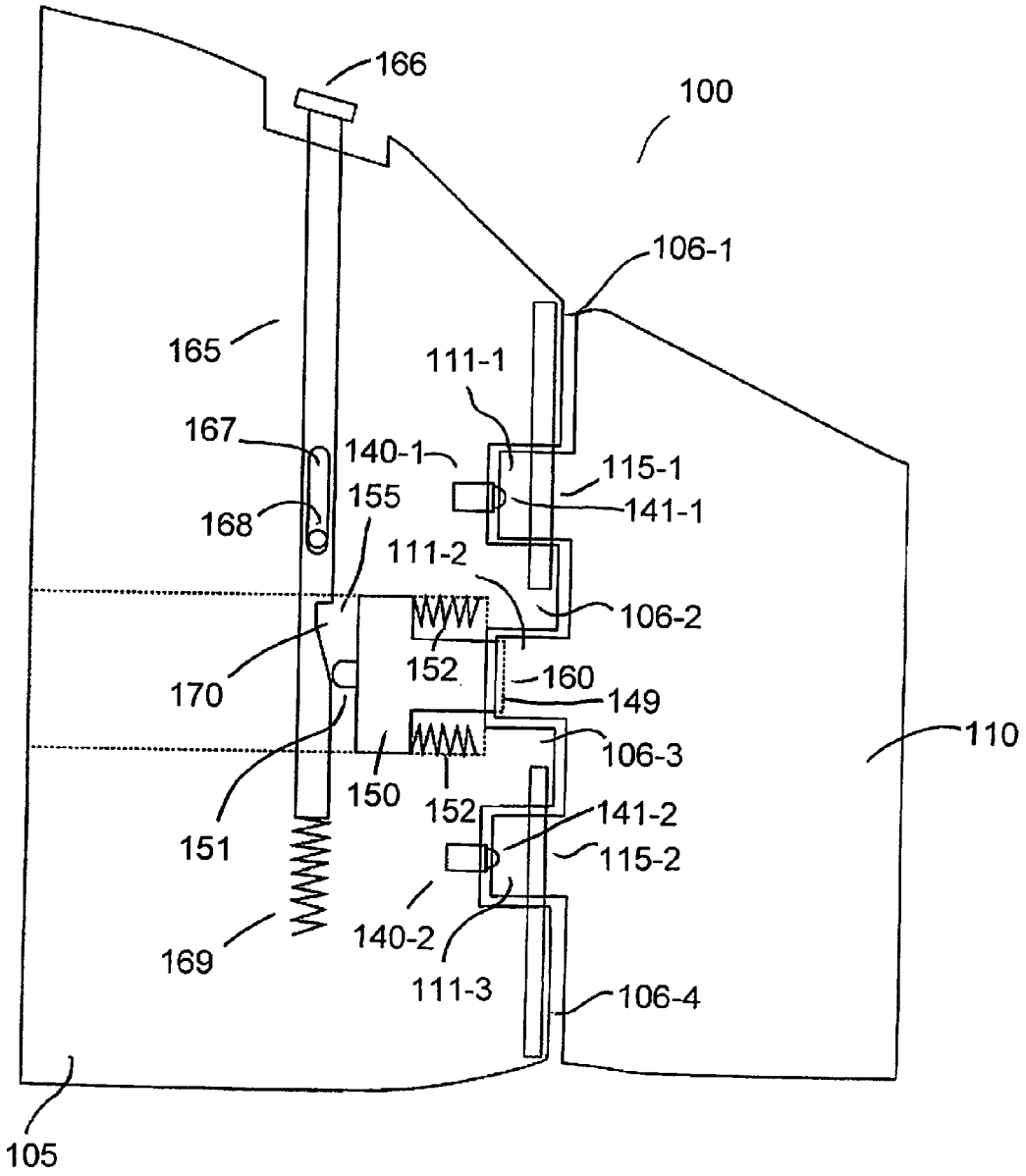
FIG. 1 illustrates a top down view of a shoe hinge member according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The components of the embodiments of the present invention may be fabricated of any suitable materials, including plastics, alloys, composites and metals and may be fabricated using suitable techniques including molding, machining and rapid prototyping.

Figure 1B:
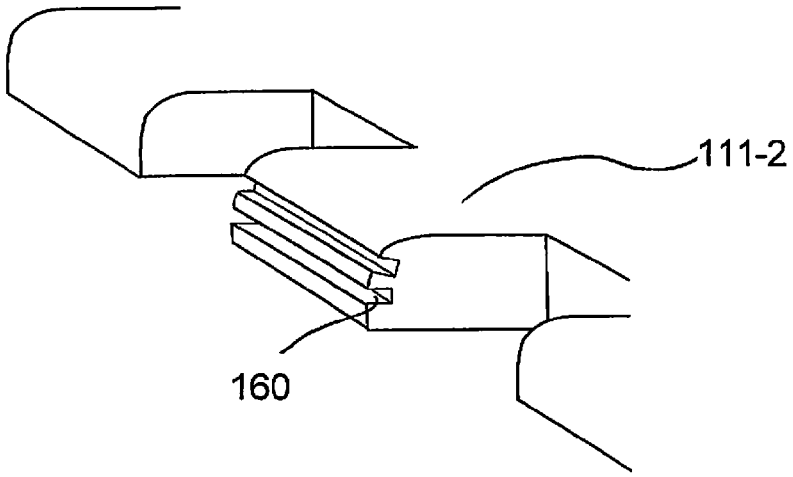
FIGS. 1*a*-1*b* illustrate perspective and side views of hinge lock components according to the embodiments of the present invention.
Figure 1A:
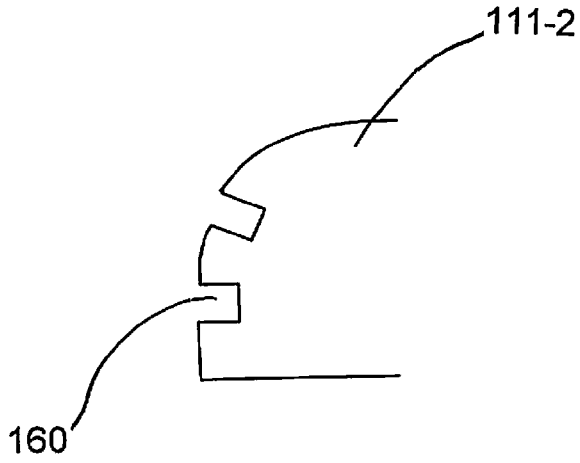
Figure 1C:
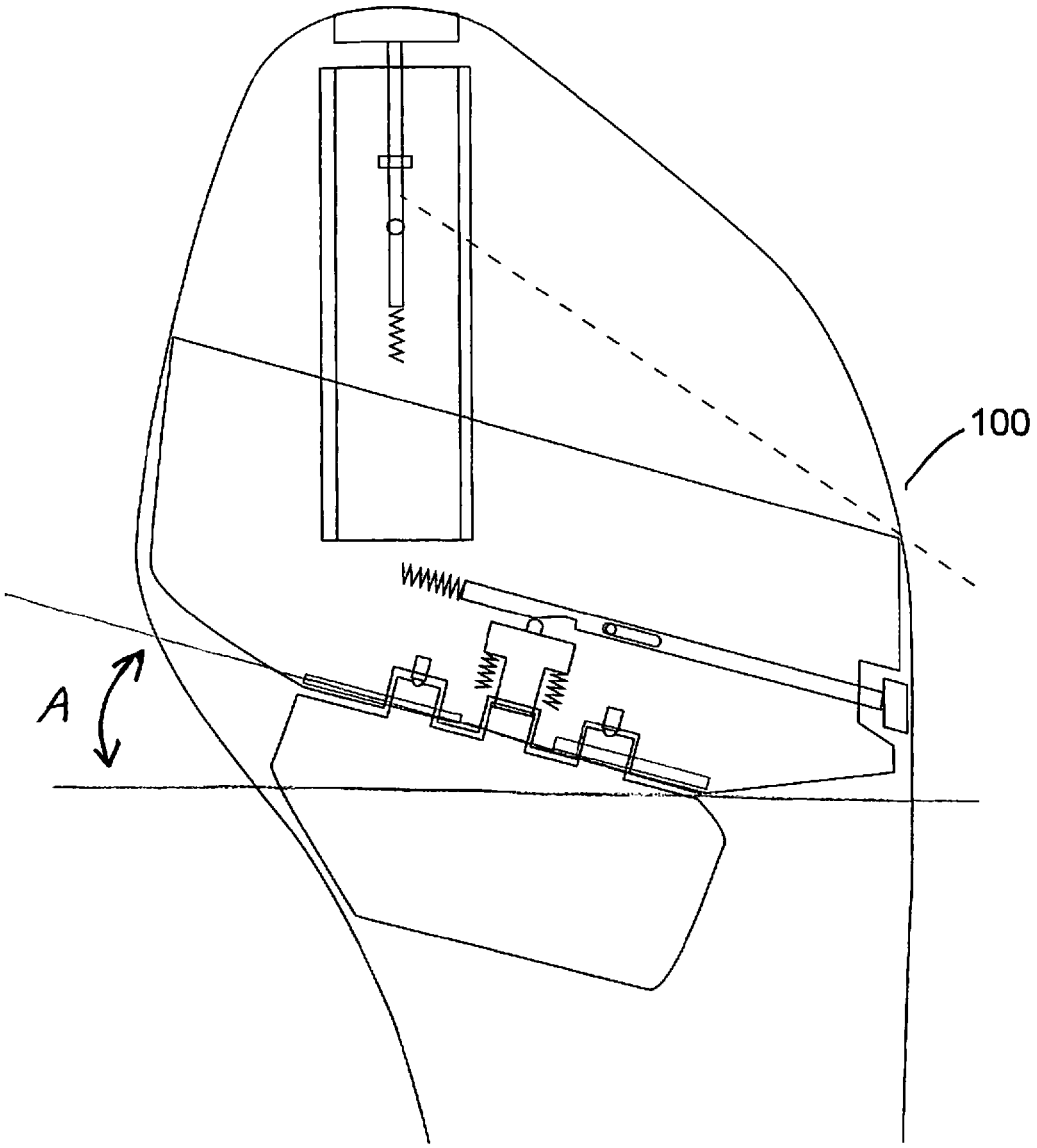
FIG. 1*c* illustrates a top down view of a shoe hinge member incorporated in a shoe according to the embodiments of the present invention.
Figure 1D:
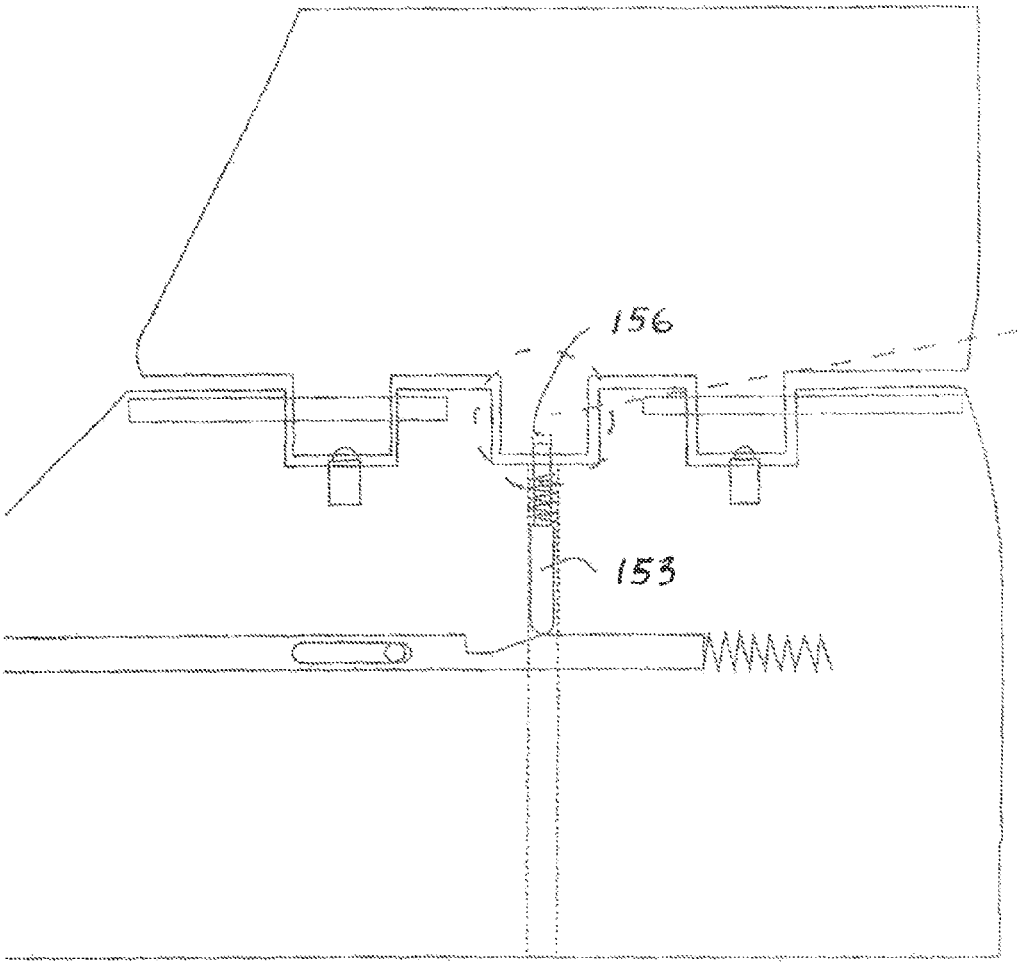
FIG. 1*d* illustrates a top down view of an alternative shoe hinge member according to the embodiments of the present invention.
Figure 1E:
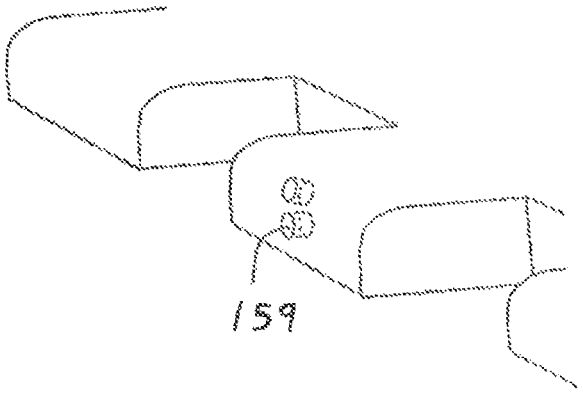
FIG. 1*e* illustrates a perspective view of alternative hinge lock components according to the embodiments of the present invention.
Figure 1F:
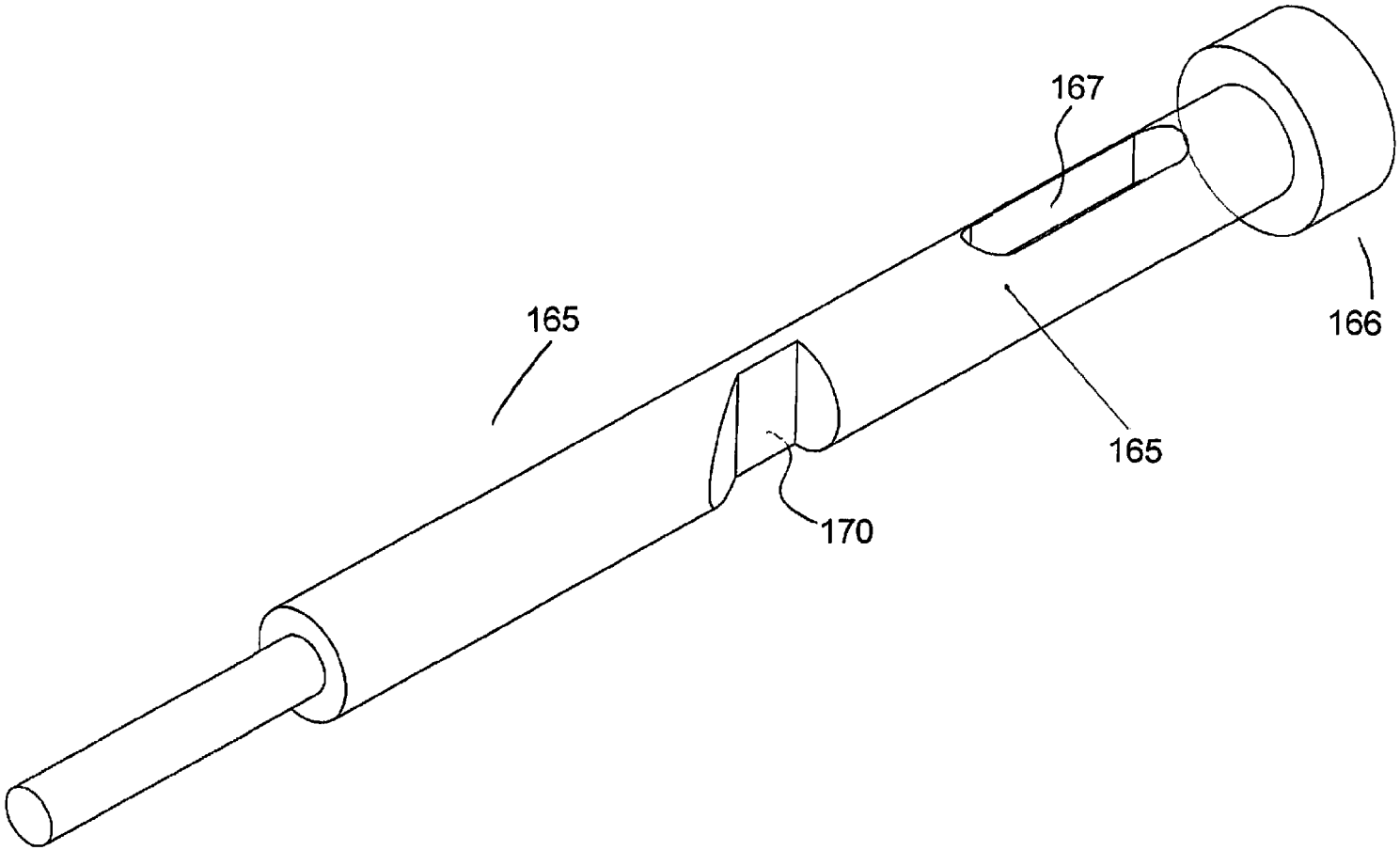
Figure 19:
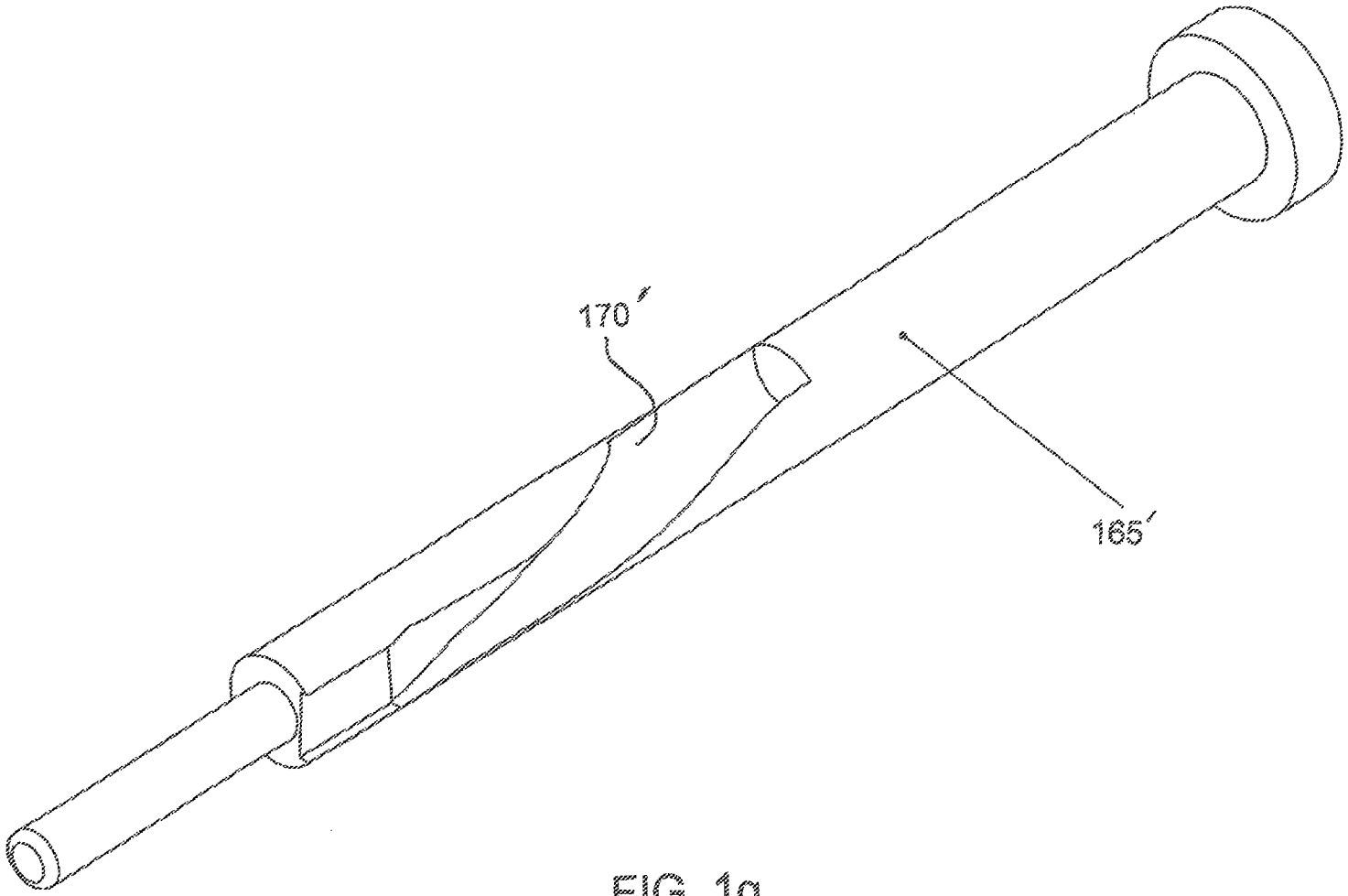
Figure 1H:
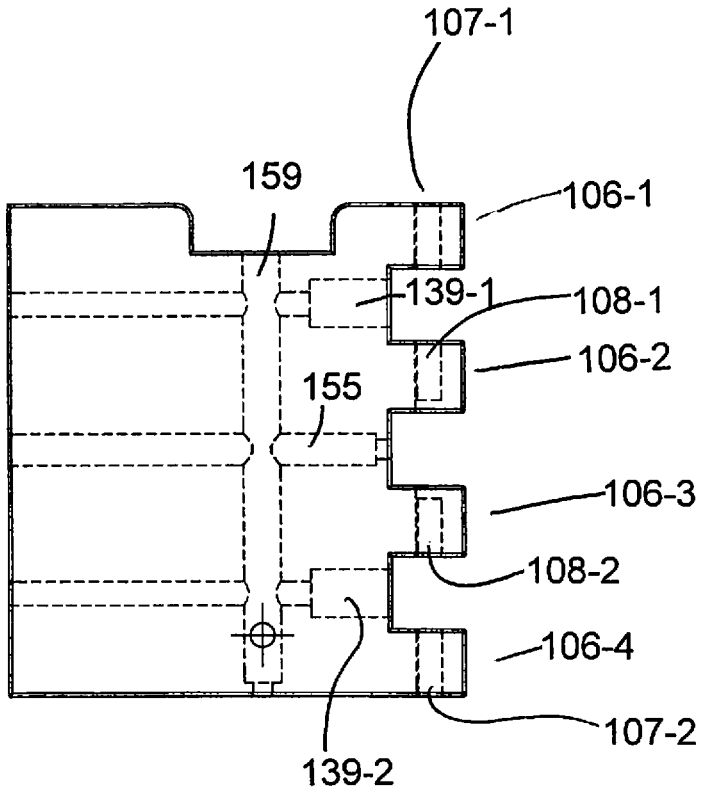
FIG. 1*h* illustrates a transparent view of a footbed toe plate according to the embodiments of the present invention.
Figure 1I:
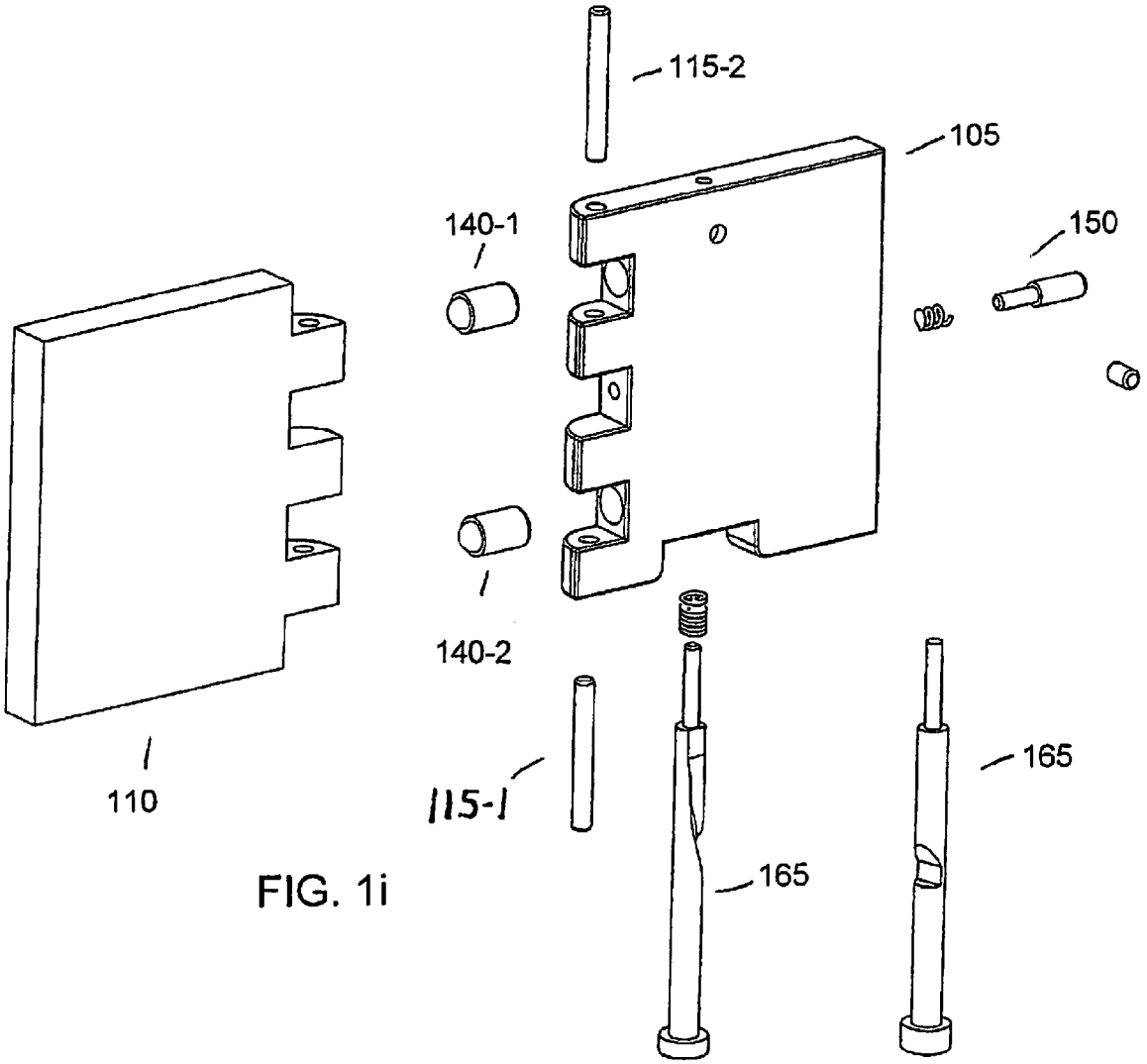
FIG. 1*i* illustrates an exploded view of the shoe hinge member according to the embodiments of the present invention.
Figure 2:
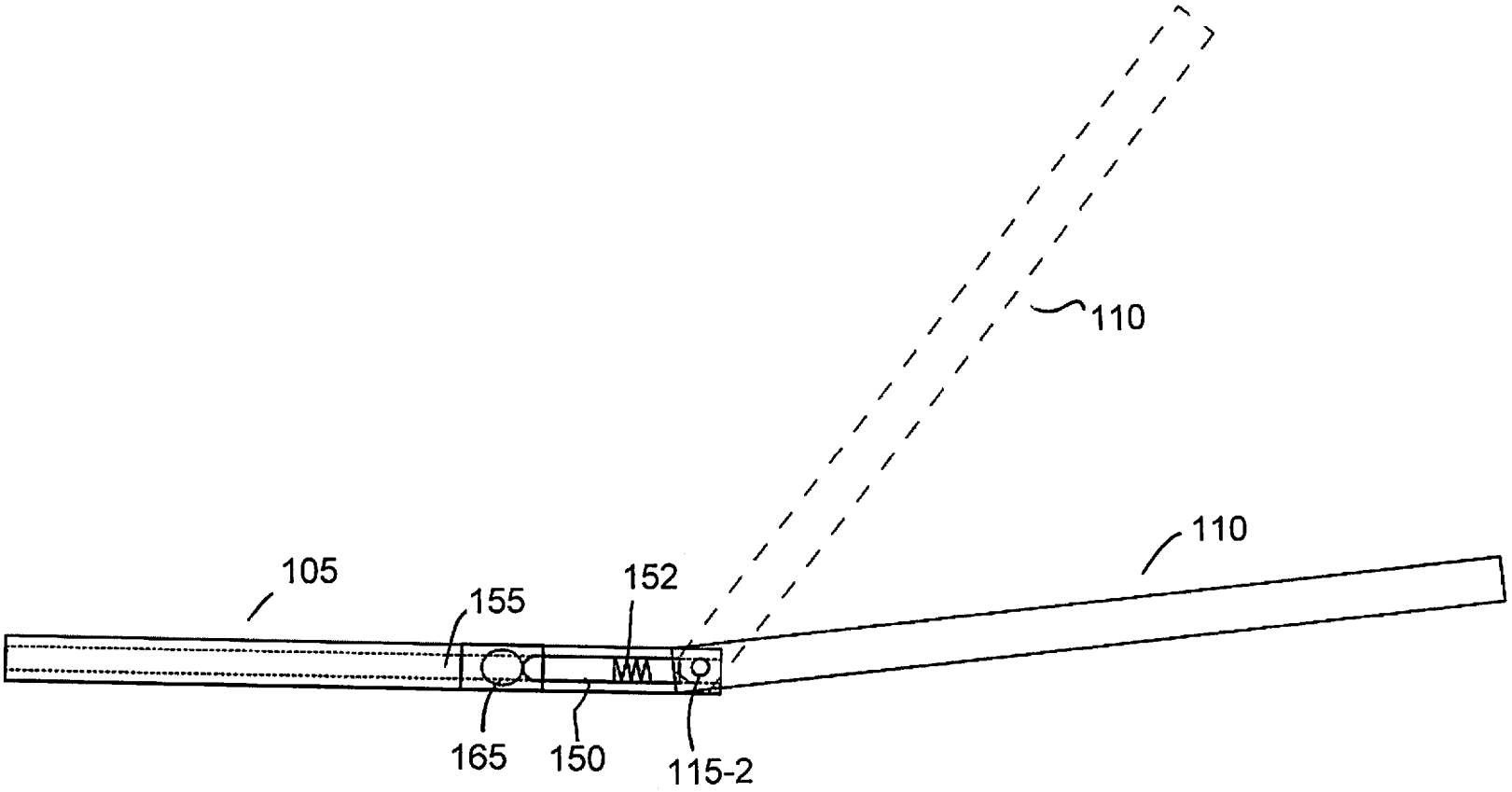
FIG. 2 illustrates side views of the shoe hinge member of FIG. 1 according to the embodiments of the present invention.
Figure 3:
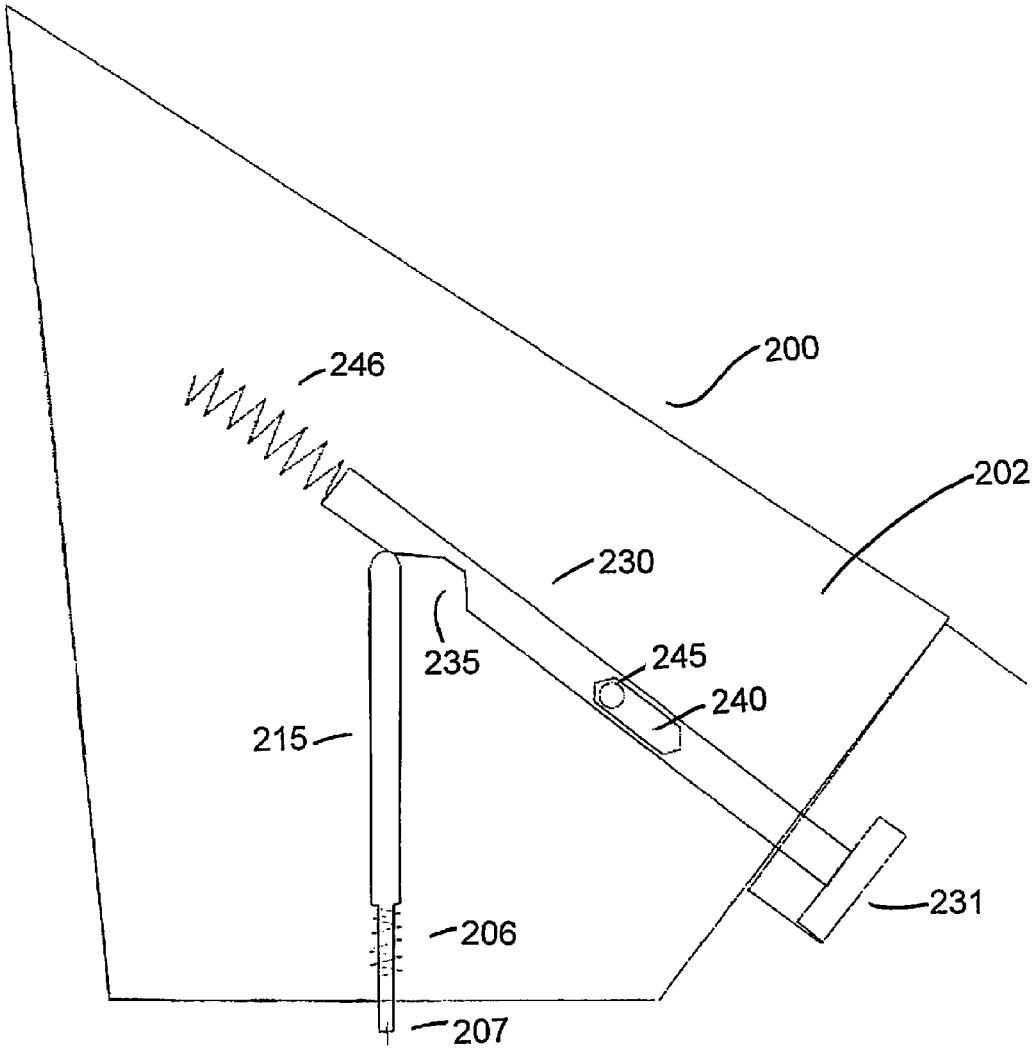
FIG. 3 illustrates a side view of a first heel block according to the embodiments of the present invention.
Figure 4:
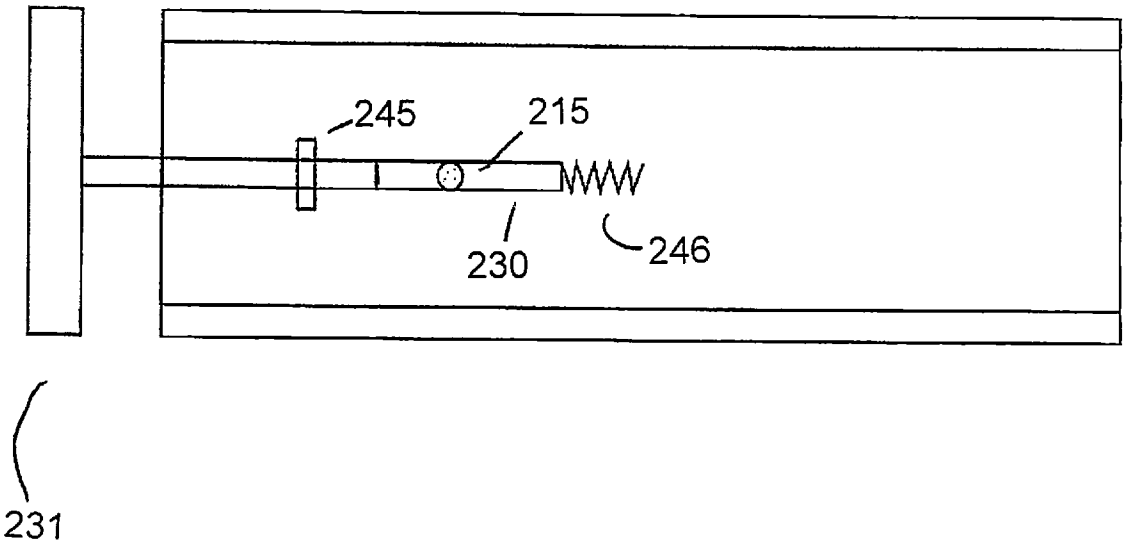
FIG. 4 illustrates a top view of the first heel block of FIG. 3 according to the embodiments of the present invention.
Figure 5:
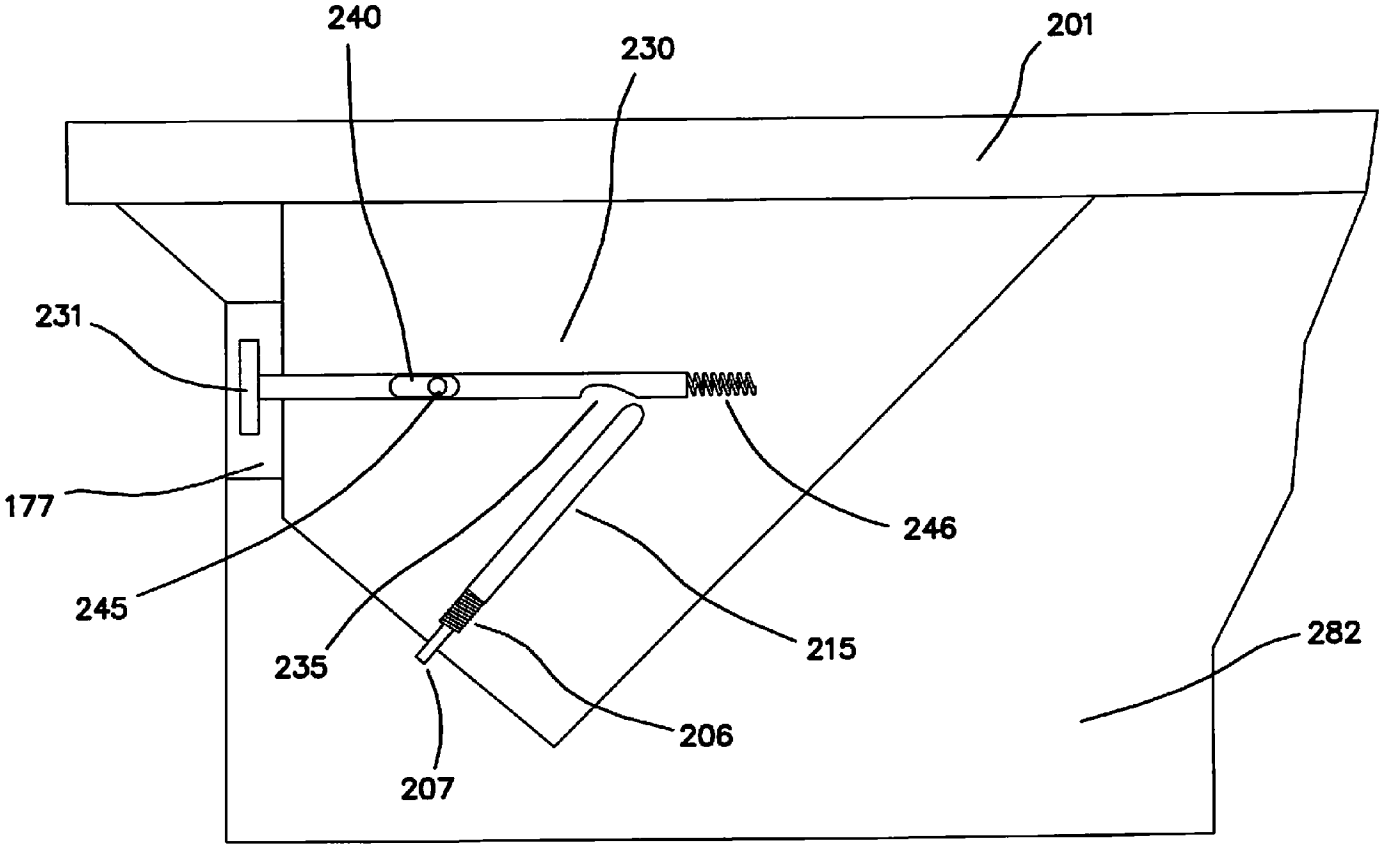
FIG. 5 illustrates a front view of a second heel block according to the embodiments of the present invention.
Figure 6:
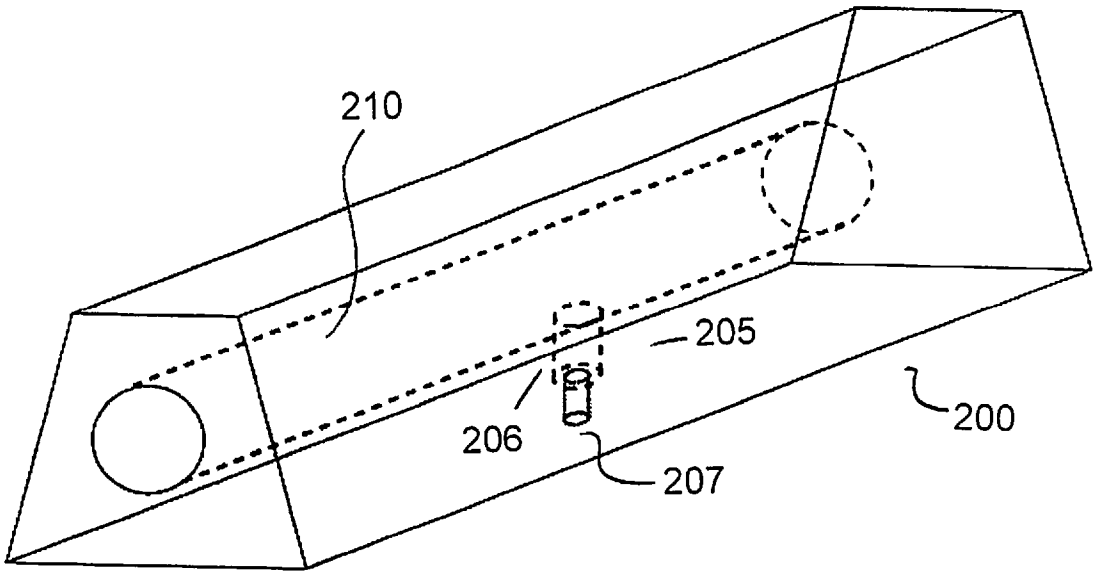
FIG. 6 illustrates a perspective heel block with internal portions shown according to the embodiments of the present invention.

FIGS. 1, 1*a*-1*i* and 2 show a shoe hinge member 100 according to the embodiments of the present invention. The hinge member 100 comprises generally a footbed toe plate 105 and footbed arch plate 110. The footbed toe plate 105 includes multiple teeth 106-1 through 106-4 which interlace with teeth 111-1 through 111-3 of the footbed arch plate 110. As shown in FIGS. 1, 2 and 1*h*, a first pin 115-1 extends through a channel 107-1 in tooth 106-1 of said footbed toe plate 105 and a channel in tooth 111-1 of said footbed arch plate 110 and into a cavity 108-1 in said tooth 106-2 of said footbed toe plate 105. Similarly, a second pin 115-2 extends through a channel 107-2 in tooth 106-4 of said footbed toe plate 105 and a channel in tooth 111-3 of said footbed arch plate 110 and into a cavity 108-2 in said tooth 106-3 of said footbed toe plate 105. The first pin 115-1 and second pin 115-2 may be secured within the respective channels with end caps or other mechanical components. Alternatively, a frictional relationship between the pins 115-1 and 115-2 and channels secures the pins 115-1 and 115-2 in place while allowing rotation of the footbed arch plate 110 relative to the footbed toe plate 105.

A pair of recessed ball plungers 140-1, 140-2 in channels 139-1, 139-2 of said footbed toe plate 105 communicates with spaced indentations in said teeth 111-1, 111-3 of said footbed arch plate 110. This relationship provides an audible noise (i.e., "click") as the footbed arch plate 110 is rotated relative to the footbed toe plate 105. The clicking noise provides a mechanism by which the user is able to determine when the footbed arch plate 110 is in a lockable position as detailed below.

An end section 149 of a spring-biased hinge lock 150 extends from a recess 155 in said footbed toe plate 105 to selectively engage, as shown in FIGS. 1*a* and 1*b*, one of a plurality of matching, locking cavities 160 in tooth 111-2 of said footbed arch plate 110 thereby locking the footbed arch plate 110 in place. In another embodiment as shown in FIGS. 1*d*-1*e*, a spring-biased hinge lock 153 may include a pin 156 corresponding to circular locking cavities 159 in said tooth 111-2 of said footbed arch plate 110 thereby locking the footbed arch plate 110 in place.

A spring-biased pin 165 or moveable pin integrated into channel 159 in said footbed toe plate 105 controls the spring-biased hinge lock 150. A notch 170 (as shown in FIG. 1*f*) in said spring-biased pin 165 receives an extension 151 of said spring-biased hinge lock 150 when said spring-biased hinge lock 150 is disengaged. FIG. 1*g* shows an alternative spring-biased pin 165' with an alternative spiral notch 170'.

Operation of the spring-biased hinge lock 150 comprises applying pressure to an end cap 166 of said spring-biased pin 165 which causes: (i) the spring-biased pin 165 to move inward as slot 167 traverses along guide pin 168 and, spring 169 to compress and (ii) compressed springs 152 to urge extension 151 into notch 170 thereby removing spring-biased hinge lock 150 from one of said position cavities 160 permitting the footbed arch plate 110 to rotate relative to said footbed toe plate 105. Engaging said spring-biased hinge lock 150 occurs automatically upon release of the pressure on said end cap 166 permitting said compressed spring 169 to expand thus urging said spring-biased pin 165 outward causing said extension 151 to be urged from said notch 170 thus urging said spring-biased hinge lock 150 into one of said position cavities 160. Operation of the spring-biased hinge lock 153 is generally the same as spring-biased hinge lock 150 except that pin 156 exits from cavities 159.

FIG. 2 shows the footbed arch plate 115 in a generally horizontal or flat position and angled (in dotted lines) relative to said footbed toe plate 105. When angled, the footbed arch plate 110 is able support a medium or high heel.

FIG. 1*c* shows the shoe hinge member 100 incorporated in a shoe. As shown, the shoe hinge member 100 is angled (angle identified by A) relative to a shoe bisection line and configured to match the shoe configuration, namely the orientation of the toe footbed. Depending on the shoe, the shoe hinge member 100 may also be incorporated without the angle (see, FIG. 8*b*).

Figure 7:
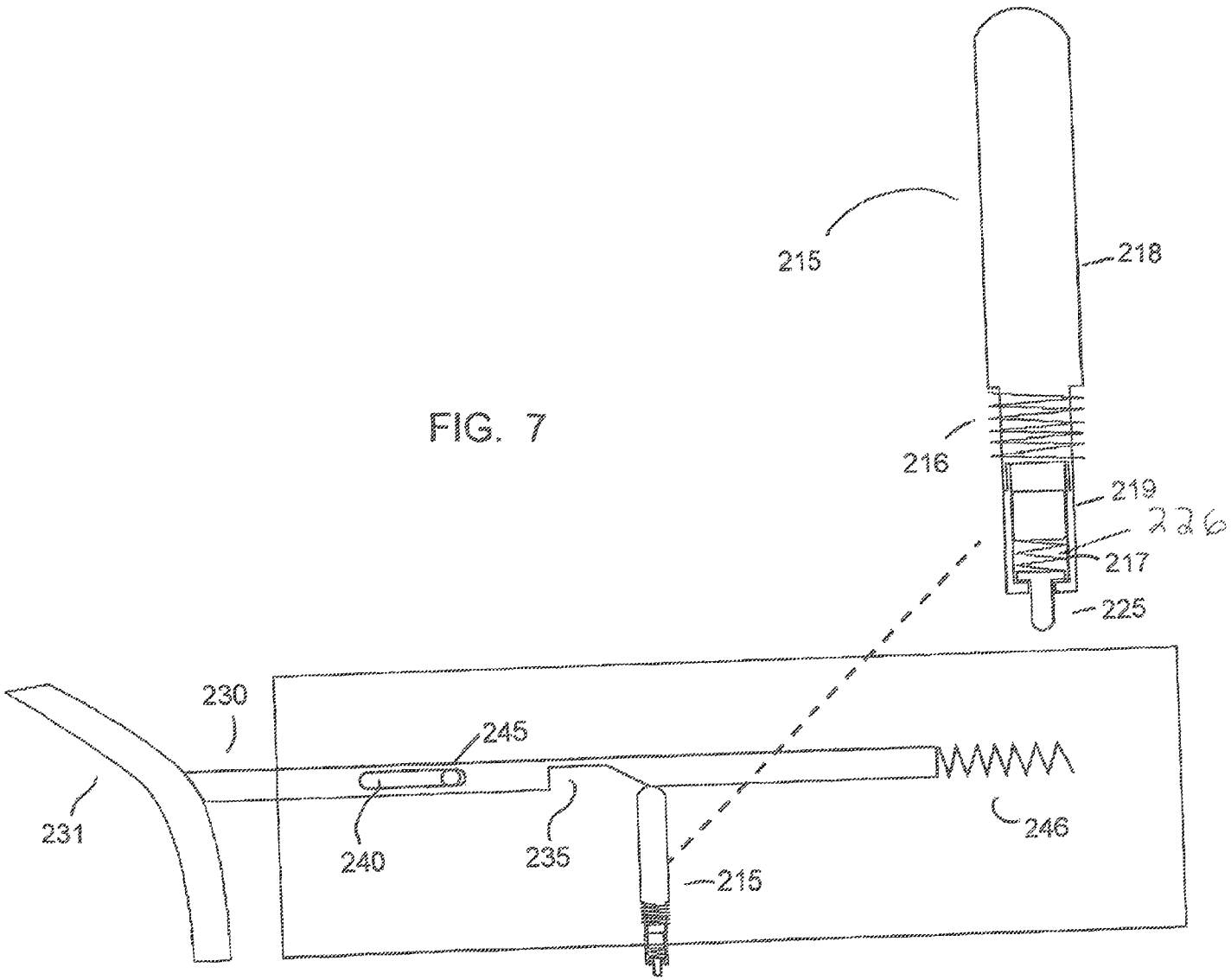
FIG. 7 illustrates a side view of a heel block and heel lock according to the embodiments of the present invention.

FIGS. 3-7 show a heel block 200 configured to accept one or more unique heels 202, 282 and is connected to a bottom surface 201 of a shoe. The heel block 200 incorporates two channels 205, 210 (FIG. 6) for accommodating a spring-biased heel lock 215 and spring-biased pin 230 or moveable pin for controlling said spring-biased heel lock 215. The spring-biased heel lock 215 is positioned within channel 205 and includes a spring 206 and a tip section 207 which extends into a removable heel with an accommodating cavity. In another embodiment, the spring-biased heel lock 215 includes an external spring 216 and interior spring 217 (FIGS. 7-9). In such an embodiment, channel 205 has an upper portion 206 having a first diameter and a lower portion 207 having a second smaller diameter wherein said upper portion 206 accommodates an upper section 218 of said spring-biased heel lock 215 and said lower portion 207 accommodates a lower section 219 of said spring-biased heel lock 215.

The spring-biased heel lock 215 includes a piston 225 contained within chamber 226 along with said biasing interior spring 217. When the spring-biased heel lock 215 is positioned within said channel 205, a portion of the chamber 226 and the contained piston 225 extend from the confines of the channel 205 for reasons described below.

The spring-biased pin 230 is positioned in channel 210 and, is configured and operates like spring-biased pin 165 shown in FIGS. 1, 1*a*-1*i* and 2. The spring-biased pin 230 includes notch 235 and slot 240 which accepts guide pin 245.

Operation of the spring-biased heel lock 215 comprises applying pressure to an end cap 231 of said spring-biased pin 230 which causes: (i) the spring-biased pin 230 to move inward as said slot 240 traverses along guide pin 245 and, spring 246 to compress; (ii) compressed external spring 216 to urge piston 225 into notch 235 thereby allowing an upper portion of said spring-biased heel lock 215 to extend into said notch 235 while said piston 225 remains extended from said channel 205. The piston 225 is able to move from an extended position if said internal spring 217 is compressed.

Figure 8A:
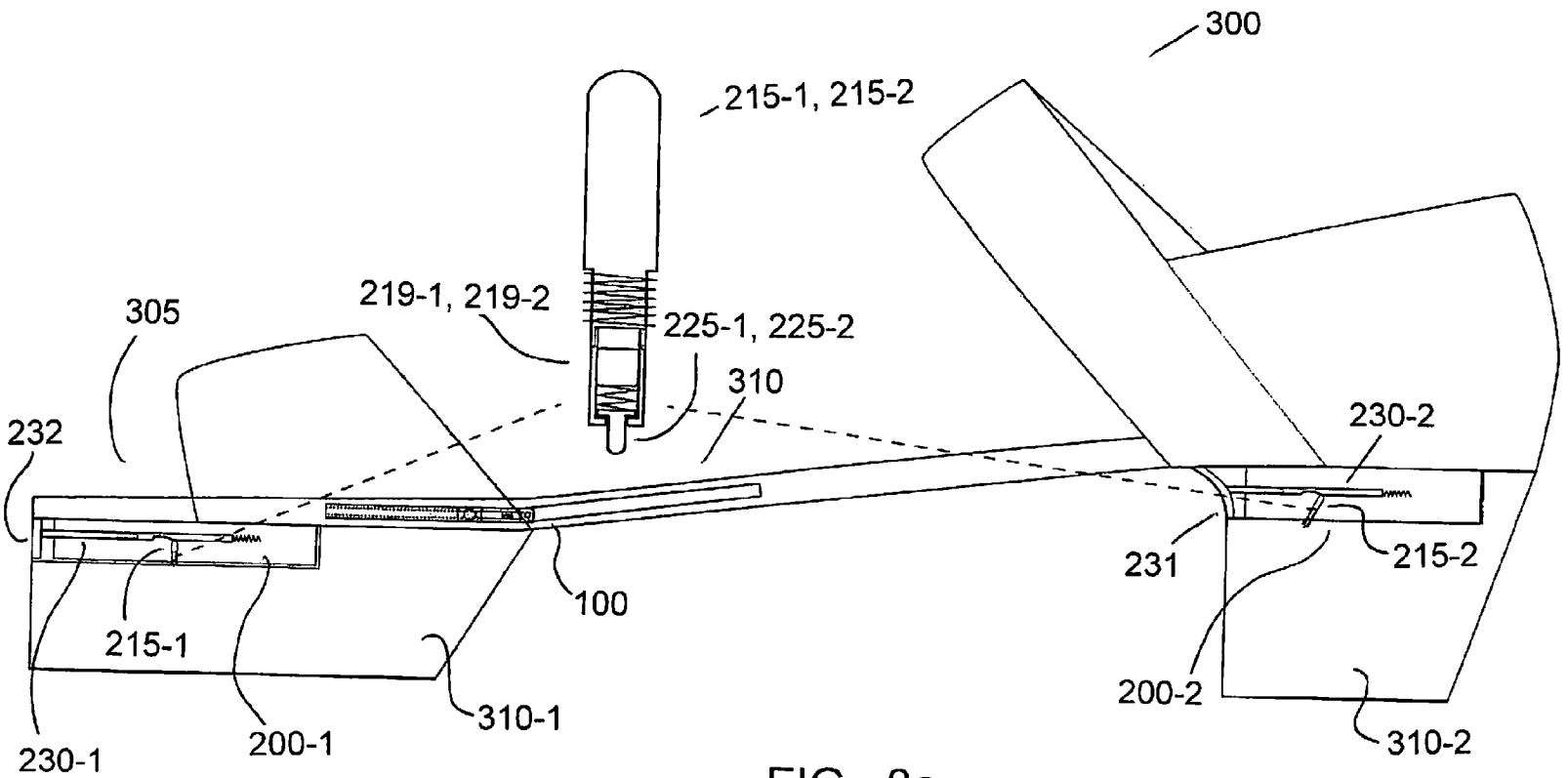
FIGS. 8*a* and 8*b* illustrate side and top down views, respectively, of a flat shoe incorporating the shoe hinge member and heel block according to the embodiments of the present invention.
Figure 8B:
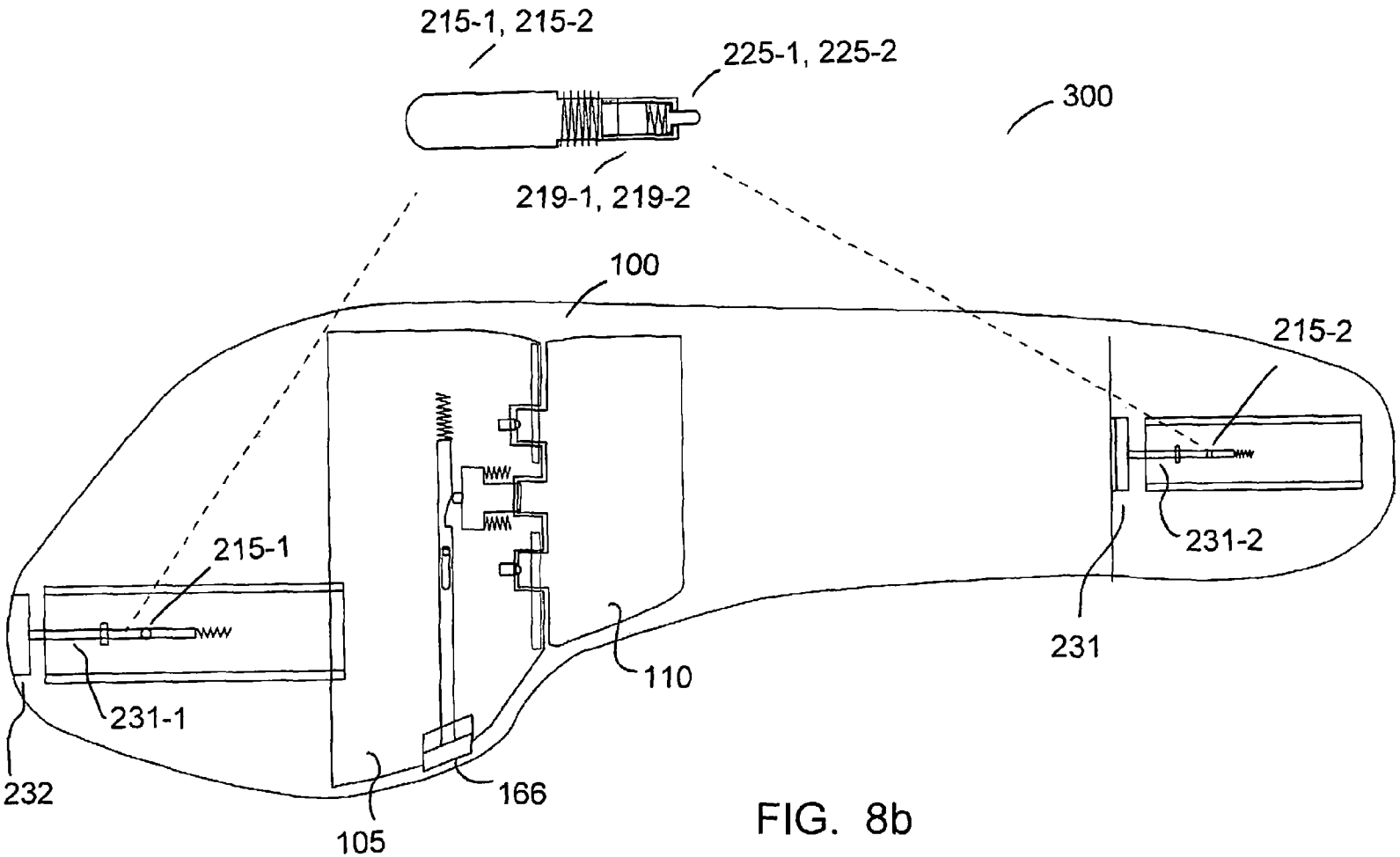
Figure 9:
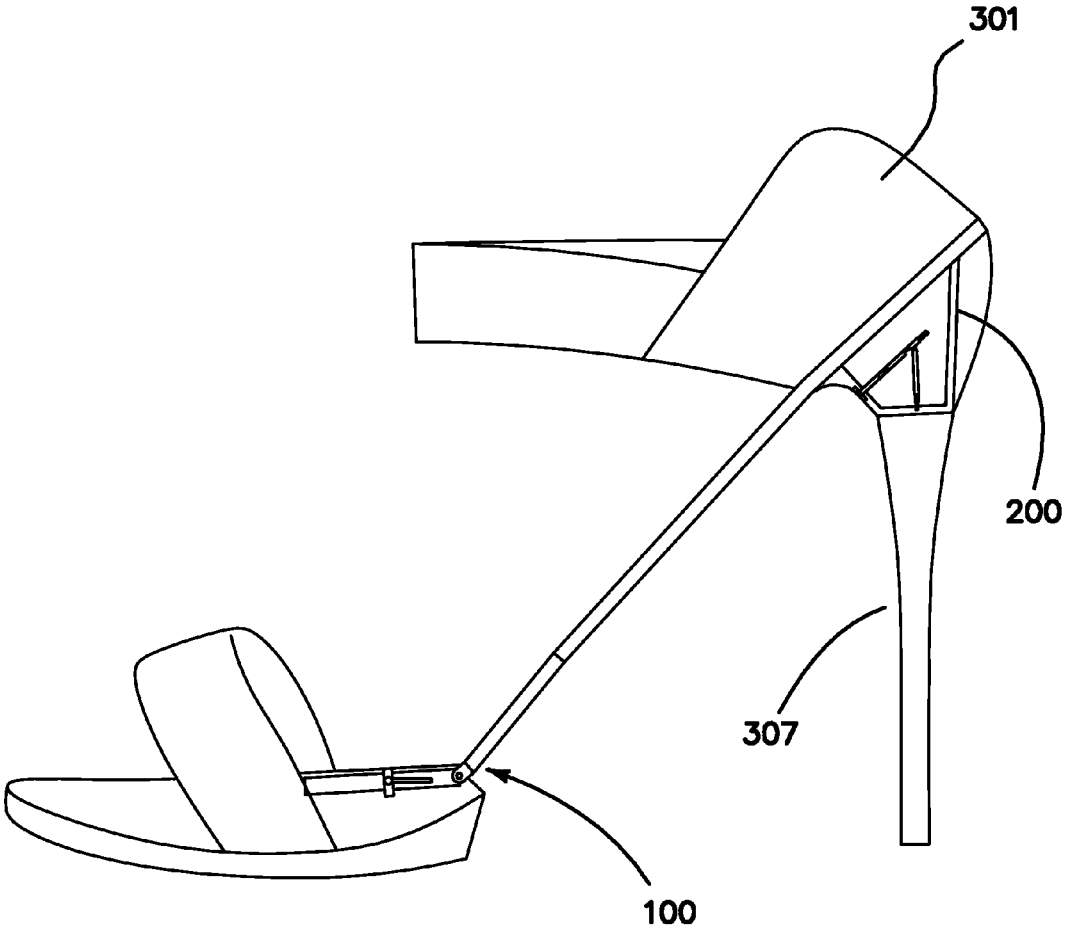
FIG. 9 illustrates a perspective view of a high heel shoe incorporating the shoe hinge member and heel block according to the embodiments of the present invention.

FIGS. 8*a*, 8*b* and 9 show the hinge member 100 and two shoe blocks 200-1, 200-2 incorporated into a shoe 300. The hinge member 100 is integrated within, and substantially concealed by, the toe footbed 305 and arch footbed 310 of the shoe 300. Only the end caps 166, 231 and 232 are exposed for a user to depress. Accordingly, the end caps 166, 231 and 232 may be covered with material matching the shoe 300. The heel blocks 200-1, 200-2 are attached to a bottom surface of the shoe 300 using conventional attachment means such as screws, nails, rivets, adhesives, etc.

Figure 10B:
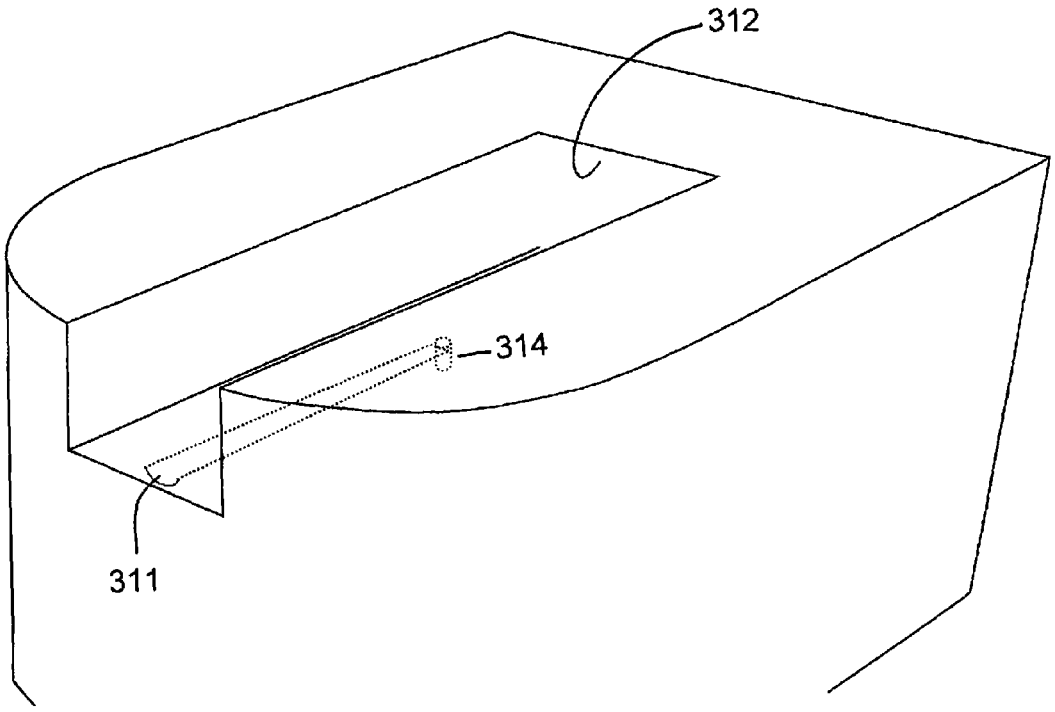
FIGS. 10*a* and 10*b* illustrates perspective and end views, respectively, of a dovetailed heel cavity according to the embodiments of the present invention.
Figure 10A:
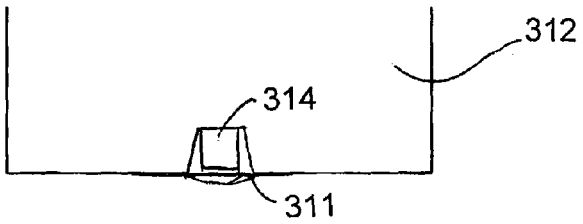

The heel blocks 200-1, 200-2 receive one of multiple heels 310-1, 310-2 configured with a void substantially matching the heel blocks 200-1, 200-2. In operation, heels 310-1, 310-2 slide onto the heel blocks 200-1, 200-2 when the spring-biased heel locks 215-1, 215-2 are disengaged responsive to end caps 166, 231 and 232 being depressed. A shown in FIGS. 10*a* and 10*b*, dovetailed channels 311 on an underside of the voids 312 of the heels 310-1, 310-2 allow the piston 225 to be initially extended from said channel 205 of the heel block 200-1, 200-2 and guided by said dovetailed channel 311 until the heel 310-1, 310-2 nears a final position at which point the piston 225 is able to further extend from channel 205 into heel cavities 314 at ends of the dovetailed channel 311. Accordingly, the heels 310-1, 310-2 are held in place via a frictional relationship between the heel blocks 200-1, 200-2 and heel voids 312 as well as the extension of the pistons 225-1, 225-2 of the spring-biased heel locks 215-1, 215-2 into the heel cavities 314.

In one embodiment, the heels 310-2 (and other heels) slide on heel block 200-2 from a rear of the shoe 300 and the spring-biased heel locks 215-2 are angled forward or oppositely such that the lower section 219-2 of the spring-biased heel lock 215-2 inserts or extends into the heel cavity in downward, forward direction thereby resisting any desire of the heel 310-2 to disengage from the heel block 200-2 in a rearward direction. FIG. 9 shows a shoe 301 having a high heel 307.

In one embodiment, the end caps 166, 231 and 232 are covered or fabricated of material 177 matching the shoe 300. Alternatively, the end caps 166, 231 and 232 are fabricated of a noticeably distinct material from the shoe 300 such that the end caps 166, 231 and 232 act as an indication of the source of the shoes incorporating the hinge member 100 and heel block 200. For example, the end cap 231 may be fabricated of silver or platinum thus being easily visible relative to the other portions of the shoe 300 and acting as a readily identifiable trademark.

The embodiments of the present invention may be made of various types of materials including plastics, alloys, metals and composites and the components may be fabricated using techniques including molding, machining and rapid prototyping. The hinge member 100 in integrated into the shoe footbed such that the line of connection/rotation between the first plate 105 and the second plate 110 aligns with a folding partition or similar shoe footbed design to allow the shoe footbed to fold or rotate commensurate with the hinge member 100. For example, in one embodiment, the shoe footbed may comprise two separate sections—(i) a toe footbed section and an (ii) arch footbed section which are joined to one another by means of a weak joint or other mechanism allowing the arch footbed section to rotate relative to the toe footbed section.

Although the invention has been described in detail with reference to several embodiments, additional variations and modifications exist within the scope and spirit of the invention as described and defined in the following claims.

We claim:

1. A shoe comprising:

a footbed;

a hinge member incorporated within said footbed, said hinge member having a first plate and a second plate joined to one another, said first plate positioned within a footbed toe area and said second plate positioned within a footbed arch area, said second plate rotatable relative to said first plate; and a hinge lock controlled by a moveable pin incorporated within said footbed, said moveable pin having a notch along its length, said hinge lock positioned to move partially into said notch so as to disengage from said second plate responsive to said moveable pin being urged inward and said hinge lock positioned to engage with said second plate responsive to said moveable pin being released, said hinge lock and moveable pin having a substantially orthogonal arrangement relative to one another.

2. The shoe of claim 1 wherein said notch takes the form of a spiral.

3. The shoe of claim 1 further comprising a guide pin received by a slot in said moveable pin.

4. The shoe of claim 1 wherein said hinge lock and moveable pin are spring-biased.

5. The shoe of claim 1 further comprising one or more ball plungers incorporated between said first and second plate and configured to generate audible noise responsive to said second plate rotating relative to said first plate, said audible noise corresponding to hinge locking positions.

6. The shoe of claim 1 wherein said hinge lock includes, at one end, locking members receivable by spaced cavities in said second plate.

7. A shoe comprising:

a footbed;

a hinge member incorporated within said footbed, said hinge member having a first plate and a second plate joined to one another, said first plate positioned within a footbed toe area and said second plate positioned within a footbed arch area, said second plate rotatable relative to said first plate;

a hinge lock integrated into said first plate, said hinge lock configured to: (i) prevent said second plate from rotating relative to said first plate when locked; and (ii) allow said second plate to rotate relative to said first plate when unlocked; and a moveable pin integrated into said first plate, said moveable pin having a notch along its length and configured to: (i) when in a first position, maintain said hinge lock in a locked position; and (ii) when in a second inward position, permit said hinge lock to move partially into said notch maintaining said hinge lock in an unlocked position, said hinge lock and moveable pin having a substantially orthogonal arrangement relative to one another.

8. The shoe of claim 7 wherein said notch takes the form of a spiral.

9. The shoe of claim 7 further comprising one or more ball plungers incorporated between said first and second plate and configured to generate audible noise responsive to said second plate rotating relative to said first plate, said audible noise corresponding to hinge locking positions.

10. The shoe of claim 6 wherein said hinge lock includes, at one end, locking members receivable by spaced cavities in said second plate.

11. A shoe comprising:

a footbed;

a hinge member incorporated within said footbed at an angle matching an orientation of a toe footbed, said hinge member having a first plate and a second plate joined to one another, said first plate positioned within a footbed toe area and said second plate positioned within a footbed arch area, said second plate rotatable relative to said first plate;

said first plate including a hinge lock, said hinge lock configured to: (i) prevent said second plate from rotating relative to said first plate when locked; and (ii) allow said second plate to rotate relative to said first plate when unlocked; and said first plate further including a moveable pin, said moveable pin, when in a first position, maintaining said hinge lock in a locked position, said movable pin including a notch which, responsive to inward pressure on said movable pin, partially receives said hinge lock thereby unlocking said first plate and second plate, said hinge lock and moveable pin having a substantially orthogonal arrangement relative to one another.

12. The shoe of claim 11 wherein said notch takes the form of a spiral.

13. The shoe of claim 11 further comprising a guide pin received by a slot in said moveable pin.

14. The shoe of claim 11 wherein said hinge lock and moveable pin are spring-biased.

15. The shoe of claim 11 further comprising one or more ball plungers incorporated between said first and second plate and configured to generate audible noise responsive to said second plate rotating relative to said first plate, said audible noise corresponding to hinge locking positions.

16. The shoe of claim 11 wherein said hinge lock includes, at one end, locking members receivable by spaced cavities in said second plate.

* * * * *